US006931977B2

(12) United States Patent
Rothenbuhler

(10) Patent No.: US 6,931,977 B2
(45) Date of Patent: Aug. 23, 2005

(54) PROTECTIVE DEVICE FOR A FIELD APPARATUS

(75) Inventor: Neal H. Rothenbuhler, Acme, WA (US)

(73) Assignee: Rothenbuhler Engineering Company, Sedro Wooley, WA (US)

( * ) Notice: Subject to any disclaimer, the term of this patent is extended or adjusted under 35 U.S.C. 154(b) by 0 days.

(21) Appl. No.: 10/767,005

(22) Filed: Jan. 28, 2004

(65) Prior Publication Data

US 2004/0211311 A1 Oct. 28, 2004

Related U.S. Application Data

(60) Provisional application No. 60/444,589, filed on Jan. 31, 2003.

(51) Int. Cl.[7] ..... F41H 5/00
(52) U.S. Cl. ..... 89/36.01; 89/36.07; 109/49.5
(58) Field of Search ..... 89/36.01, 36.07; 109/58, 1 R, 49.5

(56) References Cited

U.S. PATENT DOCUMENTS 626,402 A * 6/1899 Zinn ..... 109/49.5
1,273,371 A * 7/1918 Hudziak ..... 109/49.5
2,109,831 A * 3/1938 Szalkay ..... 109/49.5
2,370,596 A * 2/1945 Wallace ..... 109/49.5
4,626,294 A * 12/1986 Sanders, Jr. ..... 148/692
5,293,807 A * 3/1994 Hajdu ..... 89/36.07

* cited by examiner

*Primary Examiner*—J. Woodrow Eldred
(74) *Attorney, Agent, or Firm*—Christensen O'Connor Johnson Kindness PLLC

(57) ABSTRACT

A protective device for a field apparatus includes first and second lateral plates, each plate having a top end and a bottom end. The first and second lateral plates are opposingly situated to mutually support each other in an A-shaped structure. In this A-shaped structure, the top ends are coupled together by at least one coupling device substantially at the apex of the "A", and the bottom ends are coupled together by a fastening assembly. The bottom fastening assembly acts to restrain the rending of the A-shaped structure by a force generated from debris striking the first or second lateral plate. Each lateral plate also has a handle positioned in proximity to the top end. When a user grabs both handles, the A-shaped structure collapses for storage. The protective device further includes a transmission line and a device for transmitting and receiving radio waves to an electromagnetic field apparatus.

6 Claims, 3 Drawing Sheets

PROTECTIVE DEVICE FOR A FIELD APPARATUS

CROSS-REFERENCE TO RELATED APPLICATION

This application claims the benefit of U.S. Provisional Application No. 60/444,589, filed Jan. 31, 2003, which is herein incorporated by reference.

FIELD OF THE INVENTION

The invention relates generally to protective devices and, more particularly, to protective devices for electromagnetic field apparatuses and other field apparatuses.

BACKGROUND OF THE INVENTION

Blast sites are areas that can be hazardous to people and equipment due to fly rock or loose rolling rock generated from the blast. Blasts can be triggered by electromagnetic remote units or other instruments that are positioned closer to the blast sites than the human operators of the blast. These instruments can be damaged or destroyed by blast debris.

Protective devices for these instruments are generally designed as box-shaped structures. Box-shaped protective devices must withstand the full downward force of any blast debris. Therefore, there exists a need for a protective device designed to cover and protect instruments in the field that does not necessarily need to withstand the full downward force of blast debris.

In addition, if an electromagnetic unit is covered by a shield, electromagnetic signals may also be shielded and, as a result, these signals may not transmit or be received. Therefore, there further exists a need for a protective device for an electromagnetic field apparatus that allows for the transmission and receipt of electromagnetic signals.

SUMMARY OF THE INVENTION

In accordance with the present invention, a device and method for protecting a field apparatus is provided, the device form of the invention includes a protective device for a field apparatus. The protective device includes first and second lateral plates, each plate having a top end and a bottom end. The first and second lateral plates are opposingly situated to mutually support each other in an A-shaped structure. In this A-shaped structure, the top ends are coupled together by at least one coupling device substantially at the apex of the "A", and the bottom ends are coupled together by a fastening assembly. The fastening assembly acts to restrain the rending of the A-shaped structure by a force generated from debris striking the first or second lateral plate. Both the first and second lateral plates have handles positioned in proximity to their top ends. When a user grabs both handles, the A-shaped structure collapses for storage.

In accordance with other aspects of this invention, the device form of the invention further includes a transmission line which can be connected to a device for transmitting and receiving radio waves. The transmission line and the device for transmitting and receiving radio waves can be electrically coupled to a field apparatus that includes an electromagnetic field apparatus to supply or enhance a radio signal to or from the electromagnetic field apparatus. A protective device system for a field apparatus also includes the field apparatus. In the protective device system, the field apparatus may include an electromagnetic field apparatus.

In accordance with still yet other aspects of this invention, the method form of the invention includes using a protective device. According to the method, the user places a field apparatus within proximity to a blast site. The user then covers the field apparatus with a protective device for a field apparatus as described above. The method of using a protective device for an electromagnetic field apparatus may further include electrically coupling the electromagnetic field apparatus to a transmission line at its distal end and electrically coupling a device for transmitting and receiving radio waves to the central conductor of the transmission line at its proximal end.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

Figure 1:
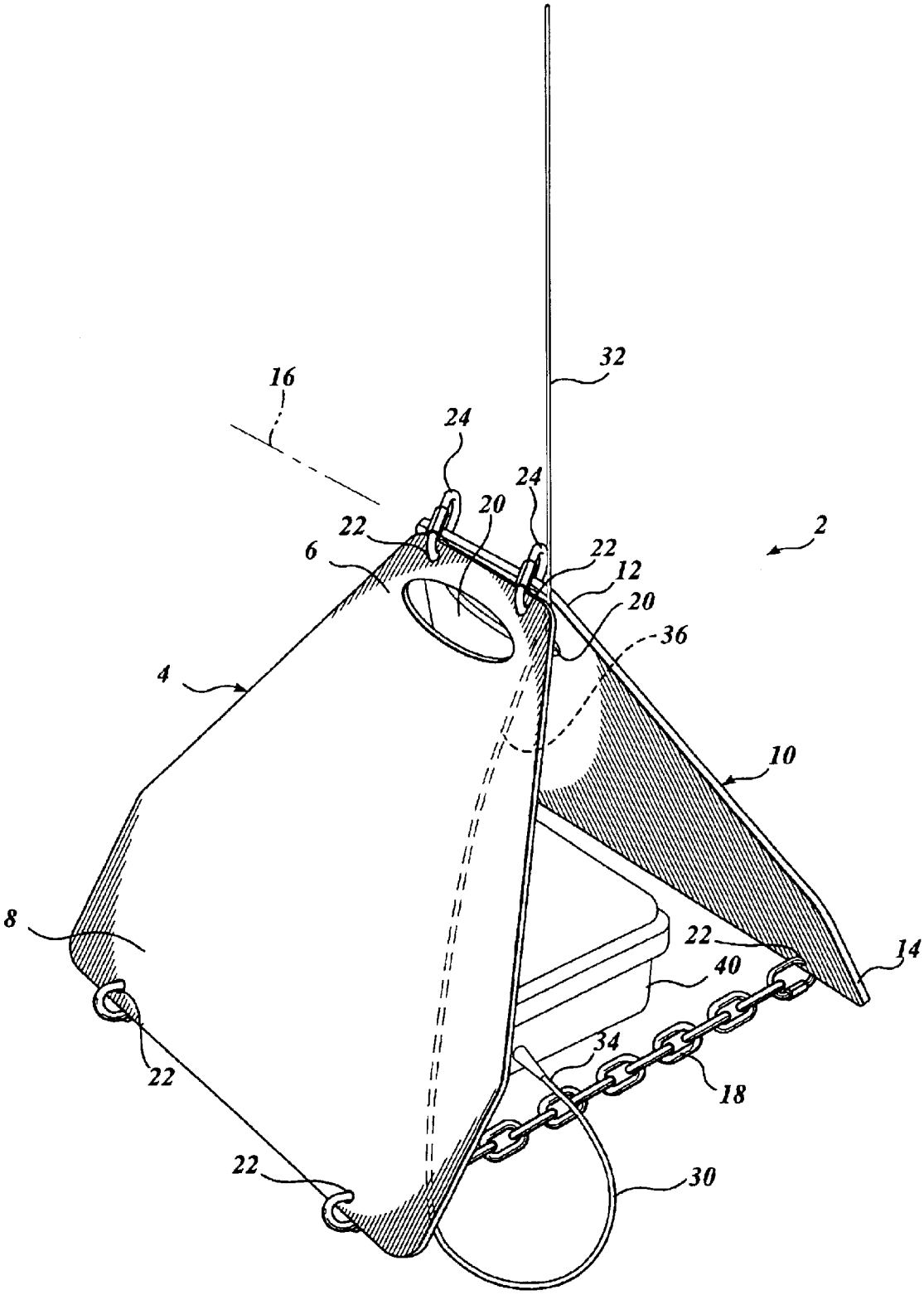
FIG. 1 is a perspective view of an exemplary protective device for a field apparatus.

FIG. 1 illustrates one embodiment of a protective device 2 in accordance with the present invention. The protective device 2 can be used to protect an electromagnetic field apparatus or another instrument 40 from debris, such as fly rock or loose rolling rock, generated from a blast. The protective device includes two lateral plates, a first lateral plate 4 and a second lateral plate 10. The first lateral plate has a top end 6 and a bottom end 8. Accordingly, the second lateral plate also has a top end 12 and a bottom end 14. The first and second lateral plates 4 and 10 are opposingly situated to mutually support each other in an A-shaped structure from the side view. To this end, the top ends 6 and 12 of the first and second lateral plates are coupled together by one or more coupling devices 24 substantially at the apex 16 of the A-shaped structure.

As shown in FIG. 1, the coupling devices 24 between the top ends 6 and 12 of the first and second lateral plates include two single and openable links of chain 24. These links of chain 24 are fed through holes 22 substantially at the apex 16 of the A-shaped structure. Other coupling devices may include, but are not limited to, nuts and bolts, ties, brackets or any other fasteners that join the plates substantially at the apex, but that also allow the plates to move about the line of the apex 16. In one embodiment, the coupling devices 24 include detachable links of about ¼ inch galvanized chain.

The bottom ends 8 and 14 of the first and second lateral plates are coupled together by an elongated fastening assembly 18. As shown in FIG. 1, the elongated fastening assembly 18 includes two lengths of chain. In another embodiment, the elongated fastening assembly may be one length of chain. In yet another embodiment, the elongated fastening assembly may be more than two lengths of chain. Suitable elongated fastening assemblies may also include other flexible fasteners, such as wire, rope, or cable. In one embodiment, the elongated fastening assembly includes lengths of about ¼ inch galvanized chain. In addition, suitable elongated fastening assemblies may include rigid fasteners such as dowels, rods, or rails. Further, a suitable elongated fastening assembly may also include a third lateral plate, similar to the first and second lateral plates 4 and 10, coupled with coupling devices (for example, links of chain 24 as shown in FIG. 1) to the bottom ends of the first and second lateral plates 8 and 14.

A suitable elongated fastening assembly 18 having rigid fasteners must be removed when the protective device 2 is collapsed for handling or storage. Flexible fasteners, however, may either be removed or may dangle when protective device 2 is collapsed for handling or storage.

The elongated fastening assembly 18 may be substantially the same length at the first and second lateral plates 4 and 10 so as to form a substantially A-shaped triangle from the side elevation view. In one embodiment, the two lateral plates and the elongated fastening assembly may substantially form an equilateral triangle from the side elevation view. In another embodiment, the two lateral plates and the elongated fastening system may substantially form an isosceles triangle from the side elevation view. In yet another embodiment, the two lateral plates and the elongated fastening system may substantially form a scalene triangle from the side elevation view.

The elongated fastening assembly 18 restrains the A-shaped structure in an upright position and prevents it from rending when a force strikes the first or second lateral plates 4 and 10. The force against the first or second lateral plates 4 and 10 may be generated by falling or striking debris, such as fly rock or loose rolling rock, from a blast. In deflecting falling or striking debris, the A-shaped structure does not need to withstand the full downward force of the debris that a box-shaped structure would need to withstand. When the debris falls or strikes the lateral plates of the A-shaped structure, the force against the A-shaped structure is not necessarily a full downward force, but may instead include shear and rotational energy.

Figure 2:
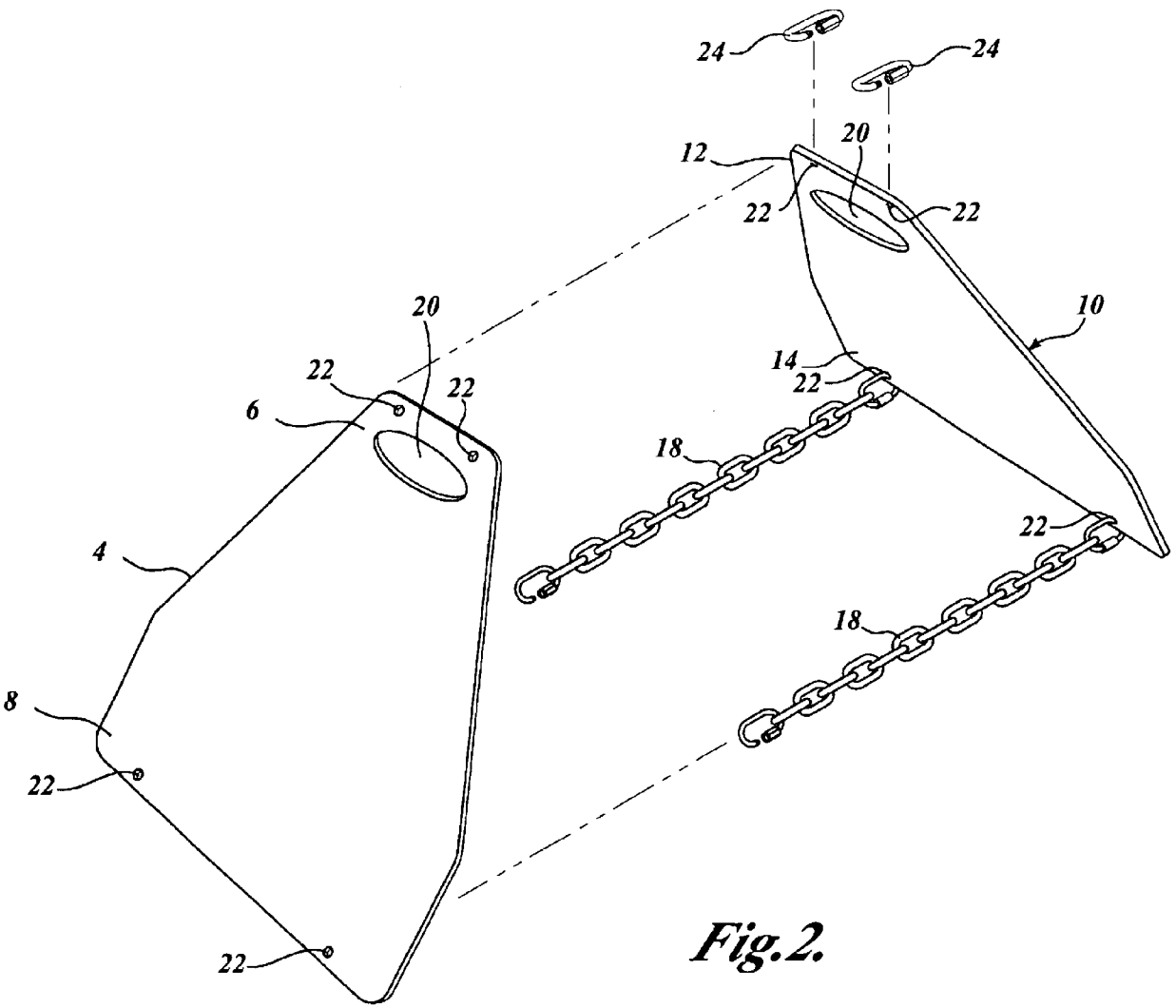
FIG. 2 is a perspective view of a disassembled protective device for a field apparatus, according to one embodiment of the present invention.

As shown in FIG. 2, the coupling devices 24 are releasably attached to holes 22 at the top ends of the first and second lateral plates 6 and 12. Further, the elongated fastening assemblies 18 are releasably attached to holes 22 at the bottom ends of the first and second lateral plates 8 and 14. When the coupling devices 24 and the elongated fastening assemblies 18 are detached from the first and second lateral plates 4 and 10, the lateral plates 4 and 10 can be separated and neatly stored by stacking multiple lateral plates on top of each other.

Figure 4:
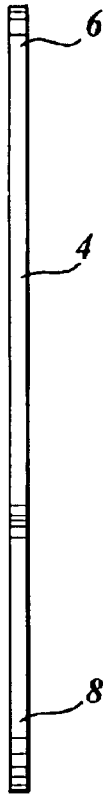
FIG. 4 is side elevation view of one exemplary lateral plate of a protective device for a field apparatus.

In one embodiment of the protective device 2, the first and second lateral plates 4 and 10 can be formed from a material selected from a group consisting of aluminum and an alloy of aluminum. In another embodiment, the lateral plates can be formed from 5052 alloy aluminum. The 5052 alloy of aluminum is lighter in weight than steel, but provides similar strength properties of steel. Other suitable materials for the lateral plates may include, but are not limited to, steel, other metals and/or metal alloys, cement, particleboard, plastic, and other natural or synthetic materials. As shown in FIG. 4, the lateral plates are preferably thinly constructed. In one embodiment, the lateral plates include a thickness greater than about ⅛ inch. In another embodiment, the lateral plates include a thickness greater than about ¼ inch. In another embodiment, the lateral plates include a thickness of greater than about ⅜ inch. In another embodiment, the lateral plates include thickness between about ⅛ and about ½ inch.

The shape of the first and second lateral plates 4 and 10 is preferably rectangular at the bottom ends 8 and 14, and preferably trapezoidal at the top ends 6 and 12. This shape enhances the strength of the protective device when the lateral plates 4 and 10 are struck by debris. One method of manufacturing the lateral plates is preferably by using a high pressure water jet to cut the shape of the plates as well as any holes in the plates. The lateral plates may also be manufactured by die-cutting, injection molding, or any other suitable method. Further, high-pressure washing, sand blasting, or chemical etching methods can be used to mark the lateral plates for identification.

Figure 3:
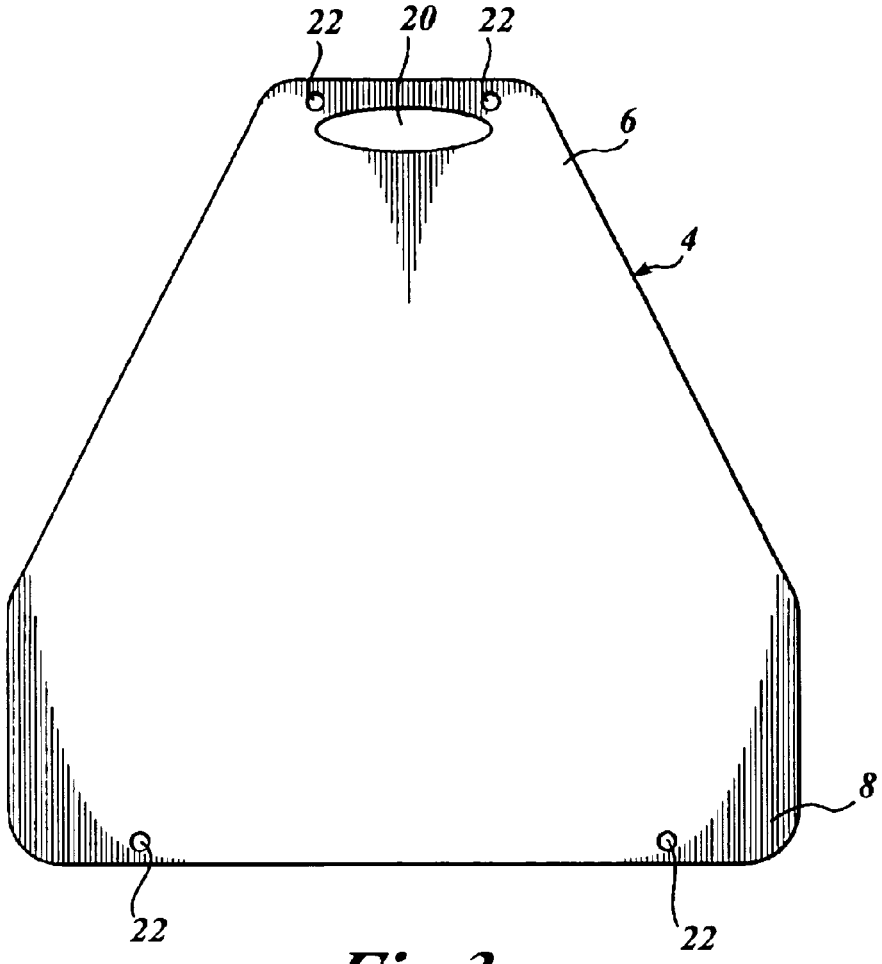
FIG. 3 is a front elevation view of one exemplary lateral plate of a protective device for a field apparatus.

Referring to FIG. 1, the lateral plates 4 and 6 have handles 20 positioned within proximity to the top ends 6 and 12. As shown in FIG. 3, the handle 20 is an opening near the top end of the plate 6. Referring to FIG. 1, as a user grabs the handles 20 of both the first and second lateral plates 4 and 10, the lateral plates collapse into each other and the flexible bottom elongated fastening system 18 dangles from the bottoms of the first and second lateral plates 8 and 14. If a rigid elongated fastening system is used with the protective device 2, the rigid fasteners must be removed before the first and second lateral plates 4 and 10 will collapse together.

Other suitable handles include, but are not limited to attached handles such as flexible or rigid rope, wire, or plastic. These handles may be attached to the top ends of the first and second lateral plates 8 and 14 by adhesive, heat, staples, or any other suitable fastener.

Referring now to FIG. 1, the protective device may further have a transmission line 30, which can be electrically coupled to a device for transmitting and/or receiving radio waves 32. When an electromagnetic field apparatus 40 is covered by the protective device 2 (particularly a metallic protective device), the electromagnetic field apparatus 40 may experience attenuation or lose its radio signal strength. The transmission line 30 and the device for transmitting and/or receiving radio waves 32 couple with one another and attach to the electromagnetic field apparatus 40 to supply (or enhance) a radio signal.

The transmission line has a distal end 34 and a proximal end 36. The transmission line 30 includes a tube of electrically conducting material surrounding a central conductor held in place by an insulator. The conducting material surrounding the central conductor at the proximal end 36 may be electrically coupled to the device for transmitting and/or receiving radio waves 32. The distal end of the transmission line 34 may be coupled to an electromagnetic field apparatus 40.

The device for transmitting and/or receiving radio waves 32 is preferably removably connected to the first lateral plate 6 and may protrude from the protective device 2 external to the first lateral plate 6. The device for transmitting and/or receiving radio waves 32 is preferably removably connected to the top end of the first lateral plate 6 and protrudes at the apex 16 of the protective device 2 between the top ends 6 and 12 of the first and second lateral plates. The device for transmitting and/or receiving radio waves 32 is preferably bendable so that it can be bent under and between the first and second lateral plates 4 and 10 during storage, thus requiring no assembly at the blast site. The device for transmitting and/or receiving radio waves 32 is also preferably bendable so that it can withstand the impact of flying blast debris without breaking off.

The transmission line 30 may be flexible or rigid. The transmission line further may be removably connected to the interior surface of the first lateral plate 4.

The protective device may further have means for transmitting and/or receiving radio waves. Such means may include a transmission line coupled with an antenna (as shown in FIG. 1), a transmission and receiving line connected to a radio and/or a blast device, or any other device for transmitting and receiving radio waves.

The protective device 2 may be colored for effectiveness in different surroundings and/or situations. For example, the protective device 2 can be colored bright orange to be easily spotted by blast zone operators, such as heavy equipment operators, drivers, camera operators, or equipment recovery crews, in all types of weather. If the protective device is used for military applications, it can be colored to be concealable within its natural surroundings, such as in a camouflage pattern.

In another embodiment of the present invention, a protective device system for a field apparatus includes a first lateral plate 4 and a second lateral plate 10, both having top ends 6 and 12 and bottom ends 8 and 14. The first and second lateral plates 4 and 10 are opposingly situated to mutually support each other in an A-shaped structure. The top ends 6 and 12 are coupled together by at least one coupling device 24 substantially at the apex 16 of the A-shaped structure and the bottom ends 8 and 14 are coupled together by a fastening assembly 18 that restrains the rending of the A-shaped structure by a force generated from debris striking the first or second lateral plate 4 or 10. The first and second lateral plates 4 and 10 also each have a handle 20 positioned within proximity to the top ends 6 and 12 by which the A-shaped structure can be collapsed for storage. Also included in the protective device system, is a field apparatus to be protected. The field apparatus to be protected may include an electromagnetic field apparatus.

Further in accordance with the present invention, a method of using a protective device 2 is provided. According to the method, the user places a field apparatus 40 within proximity to a blast site. The user then covers the electromagnetic field apparatus 40 with a protective device 2 having first and second lateral plates 4 and 10, both having top ends 6 and 12 and bottom ends 8 and 14. The first lateral plate 4 and the second lateral plate 10 are opposingly situated to mutually support each other in an A-shaped structure, with the top ends 6 and 12 coupled together by at least one coupling device 24 substantially at the apex 16 of the A-shaped structure and the bottom ends 8 and 14 coupled together by a fastening assembly 18 that restrains the rending of the A-shaped structure by a force generated from debris striking the lateral plates 4 and 10. The first and second lateral plates both have handles 20 positioned in proximity to their top ends 6 and 12. When the user grabs the handles 20, the A-shaped structure collapses for storage.

In another embodiment of the present invention, the method of using a protective device for a field apparatus further includes electrically coupling an electromagnetic field apparatus 40 to be protected to a transmission line 30 at its distal end 34. In yet another embodiment, the present invention further includes electrically coupling a device for transmitting and receiving radio waves 32 to the central conductor of the transmission line at its proximal end 36.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A protective device for a field apparatus, comprising:

a first lateral plate and a second lateral plate, each having a top end and a bottom end, the first lateral plate and the second lateral plate being opposingly situated to mutually support each other in an A-shaped structure, the top ends being coupled together by at least one coupling device substantially at the apex of the A-shaped structure and the bottom ends being coupled together by a fastening assembly that restrains the rending of the A-shaped structure by a force generated from debris striking the first or the second lateral plate, each first and second lateral plate having a handle positioned within proximity to the top end by which the A-shaped structure can be collapsed for storage; and a transmission line having a distal end and a proximal end, the transmission line comprising a tube of electrically conducting material surrounding a central conductor held in place by an insulator, the conducting material surrounding the central conductor at the proximal end.

2. A protective device for a field apparatus, comprising:

a first lateral plate and a second lateral plate, each having a top end and a bottom end, the first lateral plate and the second lateral plate being opposingly situated to mutually support each other in an A-shaped structure, the top ends being coupled together by at least one coupling device substantially at the apex of the A-shaped structure and the bottom ends being coupled together by a fastening assembly that restrains the rending of the A-shaped structure by a force generated from debris striking the first or the second lateral plate, each first and second lateral plate having a handle positioned within proximity to the top end by which the A-shaped structure can be collapsed for storage;

a transmission line having a distal end and a proximal end, the transmission line comprising a tube of electrically conducting material surrounding a central conductor held in place by an insulator, the conducting material surrounding the central conductor at the proximal end; and a device for transmitting and receiving radio waves, the device for transmitting and receiving radio waves being electrically coupled to the central conductor of the transmission line at the proximal end, the distal end of the transmission line being coupled to an electromagnetic field apparatus being protected by the protective device.

3. A protective device for a field apparatus, comprising:

a first lateral plate and a second lateral plate, each having a top end and a bottom end, the first lateral plate and the second lateral plate being opposingly situated to mutually support each other in an A-shaped structure, the top ends being coupled together by at least one coupling device substantially at the apex of the A-shaped structure and the bottom ends being coupled together by a fastening assembly that restrains the rending of the A-shaped structure by a force generated from debris striking the first or the second lateral plate, each first and second lateral plate having a handle positioned within proximity to the top end by which the A-shaped structure can be collapsed for storage; and means for transmitting and receiving radio waves.

4. A method of for using a protective device for a field apparatus, comprising:

placing a field apparatus within proximity to a blast site;

covering the field apparatus with a protective device that comprises a first lateral plate and a second lateral plate, each having a top end and a bottom end, the first lateral plate and the second lateral plate being opposingly situated to mutually support each other in an A-shaped structure, the top ends being coupled together by at least one coupling device substantially at the apex of the A-shaped structure and the bottom ends being coupled together by a fastening assembly that restrains the rending of the A-shaped structure by a force generated from debris striking the first or the second lateral plate, each first and second lateral plate having a handle positioned within proximity to the top end by which the A-shaped structure can be collapsed for storage, wherein the field apparatus includes an electromagnetic field apparatus;

electrically coupling the electromagnetic field apparatus to a transmission line at a distal end, the transmission line having a distal end and a proximal end, the transmission line comprising a tube of electrically conducting material surrounding a central conductor held in place by an insulator, the conducting material surrounding the central conductor at the proximal end; and electrically coupling a device for transmitting and receiving radio waves to the central conductor of the transmission line at the proximal end.

5. A protective device system, comprising:

a first lateral plate and a second lateral plate, each having a top end and a bottom end, the first lateral plate and the second lateral plate being opposingly situated to mutually support each other in an A-shaped structure, the top ends being coupled together by at least one coupling device substantially at the apex of the A-shaped structure and the bottom ends being coupled together by a fastening assembly that restrains the rending of the A-shaped structure by a force generated from debris striking the first or the second lateral plate, each first and second lateral plate having a handle positioned within proximity to the top end by which the A-shaped structure can be collapsed for storage;

an electromagnetic field apparatus for receiving and transmitting information to initiate a blasting process; and a transmission line having a distal end and a proximal end, the transmission line comprising a tube of electrically conducting material surrounding a central conductor held in place by an insulator, the conducting material surrounding the central conductor at the proximal end.

6. A protective device system, comprising:

a first lateral plate and a second lateral plate, each having a top end and a bottom end, the first lateral plate and the second lateral plate being opposingly situated to mutually support each other in an A-shaped structure, the top ends being coupled together by at least one coupling device substantially at the apex of the A-shaped structure and the bottom ends being coupled together by a fastening assembly that restrains the rending of the A-shaped structure by a force generated from debris striking the first or the second lateral plate, each first and second lateral plate having a handle positioned within proximity to the top end by which the A-shaped structure can be collapsed for storage;

an electromagnetic field apparatus for receiving and transmitting information to initiate a blasting process;

a transmission line having a distal end and a proximal end, the transmission line comprising a tube of electrically conducting material surrounding a central conductor held in place by an insulator, the conducting material surrounding the central conductor at the proximal end; and a device for transmitting and receiving radio waves, the device for transmitting and receiving radio waves being electrically coupled to the central conductor of the transmission line at the proximal end, the distal end of the transmission line being coupled to an electromagnetic field apparatus being protected by the protective device.

* * * * *